US006990963B2

(12) United States Patent
Hara et al.

(10) Patent No.: US 6,990,963 B2
(45) Date of Patent: Jan. 31, 2006

(54) SYSTEM AND METHOD FOR VAPORIZED FUEL PROCESSING

(75) Inventors: Takeshi Hara, Saitama (JP); Masakazu Kitamoto, Saitama (JP); Hiroaki Mihara, Saitama (JP); Koichi Yoshiki, Saitama (JP); Satoru Kubo, Saitama (JP)

(73) Assignee: Honda Motor Co., Ltd., Tokyo (JP)

( * ) Notice: Subject to any disclaimer, the term of this patent is extended or adjusted under 35 U.S.C. 154(b) by 0 days.

(21) Appl. No.: 10/892,114

(22) Filed: Jul. 16, 2004

(65) Prior Publication Data

US 2005/0011499 A1 Jan. 20, 2005

(30) Foreign Application Priority Data

Jul. 18, 2003 (JP) ..... P.2003-276492

(51) Int. Cl.
*F02M 37/04* (2006.01)

(52) U.S. Cl. ..... 123/520; 123/198 D

(58) Field of Classification Search ..... 123/516, 123/518, 519, 520, 198 D
See application file for complete search history.

(56) References Cited

U.S. PATENT DOCUMENTS

| | | | | |
|---|---|---|---|---|
| 5,497,754 | A * | 3/1996 | Ito | 123/520 |
| 6,089,080 | A * | 7/2000 | Takaku et al. | 73/117.3 |
| 6,405,718 | B1 * | 6/2002 | Yoshioka et al. | 123/520 |
| 6,431,156 | B1 * | 8/2002 | Murakami et al. | 123/520 |
| 6,814,063 | B2 * | 11/2004 | Kawano et al. | 123/520 |
| 6,874,484 | B2 * | 4/2005 | Benjey | 123/520 |

FOREIGN PATENT DOCUMENTS

JP 09-151812 6/1997

* cited by examiner

*Primary Examiner*—Thomas Moulis
(74) *Attorney, Agent, or Firm*—Arent Fox, PLLC.

(57) ABSTRACT

An atmosphere-vented valve (a pressure relief section) is opened in a predetermined amount so as to reduce an inside pressure of a canister to a predetermined negative pressure (S14) while preventing an inside pressure in a fuel tank from becoming an excessively negative pressure by closing a charge passageway opening and closing valve (S18), and purging is controlled while the canister inside pressure is being reduced, whereby from a similar principle to that of vacuum distillation, the release of vaporized fuel from an absorbent is promoted so as not only to increase the purge efficiency but also to prevent the application of an unnecessary stress to the fuel tank.

18 Claims, 4 Drawing Sheets

SYSTEM AND METHOD FOR VAPORIZED FUEL PROCESSING

BACKGROUND OF THE INVENTION

The present invention relates to a system and a method for vaporized fuel processing as well as a medium recording a program for performing the method.

A vaporized fuel processing system is well known in which vaporized fuel from a fuel tank is charged into a canister for adsorption by causing the fuel tank to communicate with the canister, and vaporized fuel released from the canister is purged into an induction system of an internal combustion engine in a predetermined operating condition, and a technique described in a patent literature No. 1 can be raised as an example of the vaporized fuel processing system.

[Patent Literature No. 1] JP-A-9-151812

In the technique described in the patent literature No. 1, a vacuum or negative pressure is introduced into a vaporized fuel processing system including a canister by opening a purge control valve, as well as an atmosphere-vented (open to the atmosphere) valve, and an accumulated value for each pressure change when the negative pressure so introduced is maintained is calculated, whereby whether or not an abnormality such as leakage of vaporized fuel is occurring in the vaporized fuel processing system is checked based on the accumulated values so calculated. Note that while the technique described in the patent literature No. 1 discloses the construction for relieving the pressure in the canister, the pressure relief is carried out in order to check on the leakage of vaporized fuel only and there is disclosed no attempt to increase the purge efficiency.

Incidentally, in recent years, as emission control regulations are strengthened, while the purge flow rate of vaporized fuel needs to be increased as high as possible, since driving conditions for purging are limited, there exists a limitation on the increase in purge flow rate. Consequently, it is desired to increase the purge efficiency by increasing the purge density.

SUMMARY OF THE INVENTION

Consequently, an object of the invention is to provide a vaporized fuel processing system which can solve the problem so as to increase the purge efficiency by increasing the purge density.

With a view to attaining the object, according to a first aspect of the invention, there is provided a vaporized fuel processing system including a canister for storing an adsorbent, a charge passageway which establishes a communication between a fuel tank and the canister so as to charge vaporized fuel from the fuel tank into the canister so that the vaporized fuel so charged is adsorbed onto the adsorbent in the canister, a purge passageway which establishes a communication between the canister and an induction system of an internal combustion engine so that the vaporized fuel released from the adsorbent is purged into the induction system, an atmospheric passageway which establishes a communication between the canister and the atmosphere, a purge control valve interposed along the length of the purge passageway for opening and closing the purge passageway, a charge passageway opening and closing valve interposed along the length of the charge passageway for opening and closing the charge passageway, a pressure relief section interposed along the length of the atmospheric passageway, and a purge control section for controlling the opening of the purge control valve so as to control the purging, wherein the purge control section activates the pressure relief section so as to reduce the inside pressure of the canister to a first predetermined negative pressure while preventing the inside pressure of the fuel tank from becoming an excessively negative pressure by closing the charge passageway opening and closing valve, whereby the purging is controlled while the inside pressure of the canister is being relieved.

Further, there is provided a vaporized fuel processing method including the steps of storing an adsorbent in a canister, communicating between a fuel tank and the canister by a charge passageway, charging vaporized fuel from the fuel tank into the canister, adsorbing the vaporized fuel so charged onto the adsorbent in the canister, communicating between the canister and an induction system of an internal combustion engine by a purge passageway, purging the vaporized fuel released from the adsorbent into the induction system, communicating between the canister and the atmosphere by an atmospheric passageway, opening and closing the purge passageway by a purge control valve interposed along the length of the purge passageway, opening and closing the charge passageway by a charge passageway opening and closing valve interposed along the length of the charge passageway, interposing a pressure relief section along the length of the atmospheric passageway, controlling the opening of the purge control valve so as to control the purging by a purge control section, activating the pressure relief section by the purge control section, and reducing an inside pressure of the canister to a first predetermined negative pressure while preventing an inside pressure of the fuel tank from becoming an excessively negative pressure by closing the charge passageway opening and closing valve, whereby the purging is controlled while the inside pressure of the canister is being relieved.

Still further, there is provided a medium for recording a program for performing the vaporized fuel processing as set forth in the first aspect.

According to a second aspect of the invention, there is provided a vaporized fuel processing system as set forth in the first aspect of the invention, further including a tank inside pressure detecting section for detecting the inside pressure of the fuel tank, wherein when the inside pressure of the fuel tank so detected is higher than a predetermined pressure, the purge control section stops the operation of the pressure relief section and opens the charge passageway opening and closing valve.

Further, there is provided the vaporized fuel processing method as set forth in the first aspect, further including steps of: detecting the inside pressure of a fuel tank by a tank inside pressure detecting section, and when the inside pressure of the fuel tank so detected is higher than a predetermined pressure, stopping the operation of the pressure relief section and opening the charge passageway opening and closing valve by the purge control section.

Still further, there is provided a medium for recording a program for performing the vaporized fuel processing as set forth in the second aspect.

According to a third aspect of the invention, there is provided a vaporized fuel processing system as set forth in the first aspect of the invention, further including a canister inside pressure detecting section for detecting the inside pressure of the canister, wherein when the inside pressure of the canister so detected is lower than the predetermined negative pressure, the purge control section stops the operation of the pressure relief section and opens the charge passageway opening and closing valve.

Further, there is provided the vaporized fuel processing method as set forth in the first aspect, further including the steps of, detecting the inside pressure of a canister by a canister inside pressure detecting section, and when the inside pressure of the canister so detected is lower than the predetermined negative pressure, stopping the operation of the pressure relief section and opening the charge passageway opening and closing valve by the purge control section.

Still further, there is provided a medium for recording a program for performing the vaporized fuel processing as set forth in the third aspect.

According to a fourth aspect of the invention, there is provided a vaporized fuel processing system as set forth in the first aspect of the invention, further including a canister inside pressure detecting section for detecting the inside pressure of the canister, wherein the purge control section opens the charge passageway opening and closing valve after the inside pressure of the canister has increased to a second predetermined negative pressure when purge control is shifted from the purge control that is implemented by relieving the inside pressure of the canister to a normal purge control that is implemented by stopping the operation of the pressure relief section.

Further, there is provided the vaporized fuel processing method as set forth in the first aspect, further including the steps of detecting the inside pressure of a canister by a canister inside pressure detecting section, and opening the charge passageway opening and closing valve by the purge control section after the inside pressure of the canister has increased to a second predetermined negative pressure, when purge control is shifted from the purge control that is implemented by relieving the inside pressure of the canister to a normal purge control that is implemented by stopping the operation of the pressure relief section.

Still further, there is provided a medium for recording a program for performing the vaporized fuel processing as set forth in the forth aspect.

According to a fifth aspect of the invention, there is provided the vaporized fuel processing system as set forth in the first aspect, wherein the charge passageway opening and closing valve operates only between the fully closed position and the fully opened position.

Further, there is provided the vaporized fuel processing method as set forth in the first aspect, further including a step of, operating only between the fully closed position and the fully opened position by the charge passageway opening and closing valve.

Still further, there is provided a medium for recording a program for performing the vaporized fuel processing as set forth in the fifth aspect.

According to a sixth aspect of the invention, there is provided the vaporized fuel processing system as set forth in the first aspect, wherein the charge passageway opening and closing valve is capable to be set at any opening between the fully closed position and the fully opened position.

Further, there is provided the vaporized fuel processing method as set forth in the first aspect, further including a step of, setting at any opening between the fully closed position and the fully opened position by the charge passageway opening and closing valve.

Still further, there is provided a medium for recording a program for performing the vaporized fuel processing as set forth in the sixth aspect.

According to the first aspect of the invention, since the pressure relief section is activated to reduce the inside pressure of the canister to the first predetermined negative pressure while preventing the inside pressure in the fuel tank from becoming an excessively negative pressure by closing the charge passageway opening and closing valve, where by purging is controlled in that state, the release of vaporized fuel from the adsorbent is promoted so as to increase the purge density from a similar principle to vacuum distillation by relieving the pressure in the canister, thereby making it possible to increase the purge efficiency. In other words, the same quantity of vaporized fuel can be purged into the induction system of the internal combustion engine with a smaller purge flow rate. In addition, since the aforesaid vacuum purge control is carried out while preventing the inside pressure in the fuel tank from becoming an excessively negative pressure by closing the charge passageway opening and closing valve, there occurs no case where an unnecessary stress is given to the fuel tank, this obviating the necessity of providing reinforcement to the fuel tank.

According to the second aspect of the invention, when the inside pressure detected is lower than the predetermined pressure, the operation of the pressure relief section is stopped, and the charge passageway opening and closing valve is opened. Therefore, even in case the amount of vaporized fuel is drastically increased and the inside pressure in the fuel tank is increased to a positive pressure side while the vacuum purge control is being implemented, the pressure can be relieved to the canister side by opening the charge passageway opening valve, whereby no unnecessary stress is given to the fuel tank.

According to the third aspect of the invention, when the detected inside pressure in the canister is lower than the predetermined negative pressure, the operation of the pressure relief section is stopped, and the charge passageway opening and closing valve is opened. Therefore, there is no risk that the inside pressure in the canister becomes an excessively negative pressure, and consequently, since there is no risk that an unnecessary stress is given to the canister, the necessity is obviated of providing reinforcement to the canister.

According to the fourth aspect of the invention, when purging control is shifted from the vacuum purge control that is implemented by relieving the inside pressure in the canister to the normal purge control, the charge passageway opening and closing valve is opened after the inside pressure in the canister is increased to the second predetermined negative pressure. Therefore, there is no risk that the negative pressure generated in the canister due to the vacuum purge control acts on the fuel tank, whereby the inside pressure in the fuel tank becomes an excessively negative pressure. Consequently, there is no risk that an unnecessary stress is given to the fuel tank.

DETAILED DESCRIPTION OF THE PREFERRED EMBODIMENTS

Hereinafter, a best mode for carrying out a vaporized fuel processing system according to the invention will be described by reference to the accompanying drawings.

[First Embodiment]

Figure 1:
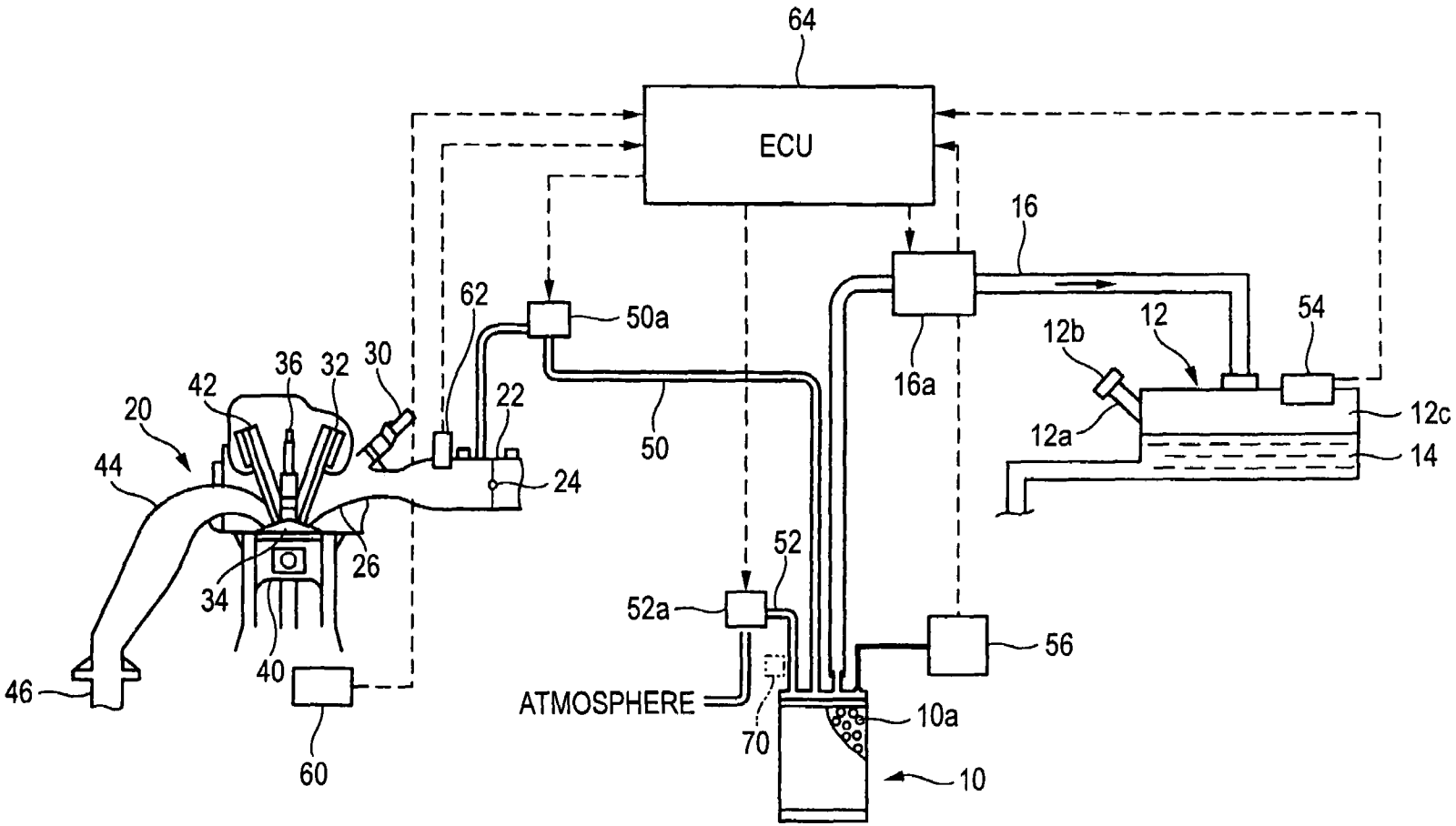
FIG. 1 is a schematic diagram showing the whole of a vaporized fuel processing system according to a first embodiment of the invention.

FIG. 1 is a schematic diagram illustrating the whole of a vaporized fuel processing system according to a first embodiment of the invention.

In FIG. 1, reference numeral 10 denotes a canister. The canister 10 is produced from a resin material or of a metallic material and stores therein an absorbent 10*a* constituted by charcoal in the form of pellet. Reference numeral 12 denotes a fuel tank, and gasoline fuel 14 is stored in the fuel tank 12. The fuel tank 12 is also produced from a resin material or of a metallic material and is made airtight and liquid-tight. An opening formed in a distal end of a filler neck 12*a* of the fuel tank 12 is closed with a filler cap 12*b*.

A communication is established between the canister 10 and a space 12*c* above the level of fuel in the fuel tank 12 via a charge passageway 16. Gasoline fuel vaporized (fuel vapor) 14 within the fuel tank 12 passes through the charge passageway 16 to flow (be charged) into the canister 10. Vaporized fuel that has flowed into the canister 10, in particular, hydrocarbon components (HC) thereof are adsorbed onto the adsorbent 10*a* stored in the interior of the canister 10.

Reference numeral 20 denotes an internal combustion engine (hereinafter, referred to as the "engine"). The engine 20 is a four-cycle, four-cylinder engine, in which air taken into from an air cleaner (not shown) flows through an induction pipe 22, passes through an induction manifold 26 with the flow rate thereof being controlled by a throttle valve 24 and reaches an induction port of each cylinder. Gasoline fuel 14 stored in the fuel tank 12 is supplied to an injector 30 via a fuel supply pipe (not shown) and is injected by the injector 30 so as to be mixed with air that has flowed thereinto to thereby form air-fuel mixture. The air-fuel mixture so formed flows into a combustion chamber 34 of each cylinder (only one of the combustion chambers is shown) when an inlet valve 32 is opened.

Air-fuel mixture that has flowed into the combustion chamber 34 is then ignited to be burned by a spark plug 36 to thereby drive a piston 40. When an exhaust valve 42 is opened, gas generated due to combustion flows through an exhaust manifold 44 and is then discharged to the atmosphere (the outside of the engine) through an exhaust pipe 46.

The canister 10 is caused to communicate with an induction system of the engine 20 or, to be more specific, with a position downstream of the throttle valve 24 via a purge passageway 50. In addition, the canister 10 is caused to communicate with the atmosphere via an atmospheric passageway 52. A purge control valve 50*a* is interposed along the length of the purge passageway 50. The purge control valve 50*a* is made up of an electromagnetic solenoid valve and opens and closes the purge passageway 50 with an opening in accordance with the amount of energy applied to a solenoid of the valve. When the purge passageway 50 is opened, vaporized fuel adsorbed onto the adsorbent 10*a* is released therefrom and is then purged into the induction system of the engine 20 with a flow rate according to the opening of the purge passageway 50.

In addition, a charge passageway opening and closing valve 16*a* is interposed along the length of the charge passageway 16. The charge passageway opening and closing valve 16*a* operates only at two positions; a fully closed position and a fully opened position, and fully opens or closes the charge passageway 16. In addition, an atmosphere-vented (open to the atmosphere) valve 52*a* is interposed along the length of the atmospheric passageway 52 as the pressure relief section. The atmosphere-vented vale 52*a* is made up of an electromagnetic solenoid valve and opens and closes the atmospheric passageway 52 with an opening in accordance with the amount of energy applied to a solenoid thereof.

When the atmosphere-vented valve 52*a* is driven to the fully opened position, the canister 10 is made to be open to the atmosphere, and the inside pressure of the canister 10 becomes the atmospheric pressure. On the other hand, as the atmosphere-vented valve 52*a* is driven from the fully opened position toward a closing direction to gradually reduce the opening of the atmospheric passageway 52, the inside pressure of the canister 10 becomes a negative pressure. Consequently, the atmosphere-vented valve 52*a* functions as a pressure relief section. In addition, when the charge passageway opening and closing valve 16*a* is driven to a fully closed position, in case the inside pressure of the canister 10 is made to be a negative pressure, since the negative pressure is prevented from being introduced into the space 12*c* above the level of fuel in the fuel tank 12, the atmosphere-vented valve 52*a* also functions as a means for preventing the generation of an excessively negative pressure in the tank.

A pressure sensor (a tank inside pressure detecting section) 54 is disposed in the fuel tank 12 for outputting a signal in accordance with the inside pressure of the fuel tank 12 or the pressure in the space 12*c* above the fuel level. In addition, a similar type of pressure sensor (a canister inside pressure detecting section) 56 is disposed in the canister 10 for outputting a signal in accordance with the inside pressure of the canister 10 or the pressure in the interior of the canister in which the adsorbent 10*a* is disposed.

In addition, a crank angle sensor 60 is provided in the vicinity of a crankshaft or camshaft (both are not shown) of the engine 20 for outputting a cylinder identifying signal, a TDC signal for each cylinder and a signal representing a crank angle resulting from the details of those signals. A absolute pressure sensor 62 is disposed in the induction pipe 22 at a position downstream of the position where the throttle valve 24 is disposed for outputting a signal in accordance with an air induction pipe inside pressure PBA (representing an engine load). Note that, while omitting a drawing, a coolant temperature sensor is disposed in the vicinity of a coolant passageway (not shown) for outputting a signal in accordance with the engine coolant temperature, and an air-fuel ratio sensor is disposed in the exhaust pipe 46 for outputting a signal in accordance with the oxygen density in exhaust emissions.

Outputs from the group of sensors are sent to an ECU (electronic control unit) 64. The ECU 64 is constituted by a microprocessor made up of a CPU, a ROM and a RAM, and outputs from the sensors are adjusted with respect to waveforms or converted into digital values via an A/D converter circuit (not shown) and are then stored in the RAM. An output from the crank angle sensor 60 is counted by a counter (not shown) so as to detect the engine rotational speed NE.

Figure 2:
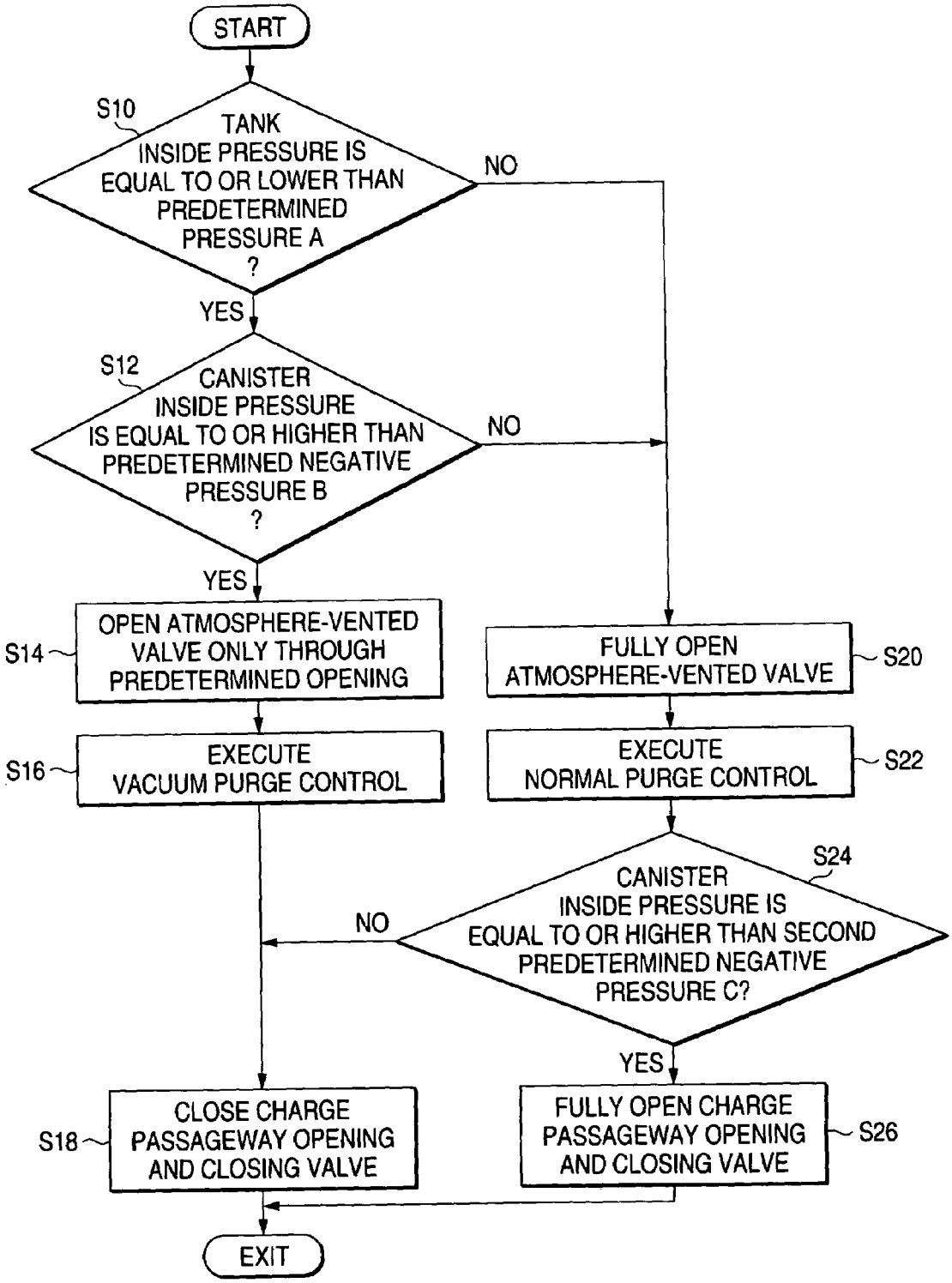
FIG. 2 is a flowchart illustrating the operation of the vaporized fuel processing system shown in FIG. 1.

FIG. 2 is a flowchart showing the operation of the vaporized fuel processing system shown in FIG. 1.

Note that the program shown illustrates the operation of the ECU 64 and is activated every time a predetermined period of time elapses or at a time intervals of, for example, 10 msec. To be more specific, the program is activated every 10 msec when the engine 20 is in an operating condition which allows for a canister purging (a vaporized fuel processing) in which vaporized fuel released from the adsorbent 10*a* in the canister 10 is purged into the induction system of the engine 20. The operating conditions which allows for the canister purging are such as a condition in which an air-fuel ratio feedback control is implemented with the engine being in a steady-state driving condition.

In the ECU 64, the CPU functions as a purge control section, identifies an operating condition which allows for a canister purging based on the detected engine rotational speed NE, air induction pipe inside pressure PAB and coolant temperature, as well as parameters indicating other operating conditions, not shown, of the engine, and executes the program.

To describe the operation according to the flowchart, in S10, whether or not the inside pressure of the fuel tank 12 is equal to or lower than a predetermined pressure A (for example, +50 mm Hg) is determined. If positive in S10, proceed to S12 and whether or not the inside pressure of the canister 10 is equal to or higher than a predetermined negative pressure B (for example,−300 mm Hg) is determined. Note that in the flowchart in FIG. 2 (and a flowchart in FIG. 5 which will be described later on), pressures are not absolute pressures but gauge pressures in which the atmospheric pressure (760 mm Hg) is made to be zero. Consequently, in S12, it is determined whether the canister inside pressure is at −300 mm Hg, a negative pressure which is smaller than −300 mm Hg or a positive pressure which is larger than −300 mm Hg.

If positive in S12, proceed to S14, and the atmosphere-vented valve 53*a* is opened only through a predetermined opening (namely, the pressure relief section is activated). To be specific, the atmosphere-vented valve 52*a* is driven from the fully closed position through the predetermined opening toward the opening direction. To be more specific, the atmosphere-vented vale 52*a* continues to be opened until an opening is reached which allows the inside pressure in the canister 10 to become a negative pressure in the order of −200 mm Hg.

Next, proceed to S16, and execute a vacuum purge control (which will be described later on), thereafter proceeding to S18, where the charge passageway opening and closing valve 16 is closed. In the above description, the vacuum purge control means an operation in which the atmosphere-vented valve 52*a* is opened by a predetermined amount so as to reduce the inside pressure in the canister 10 to a predetermined negative pressure (a first predetermined negative pressure) while preventing the inside pressure in the fuel tank 12 from becoming an excessively negative pressure by closing the charge passageway opening and closing valve 16, and the purging is controlled or the purge control valve 52*a* is opened through a certain opening (that is calculated from an estimated value of charge amount (adsorption amount)) so as to purge vaporized fuel that is released from the absorbent 10*a* into the induction system of the engine 20 while the canister inside pressure is being reduced. Note that since the gist of the patent application does not reside in the purge control itself, the detailed description thereof will be omitted.

Here, the vacuum purge control will be described. As is described before, in recent years, as the regulations on emissions are strengthened, while the purge flow rate of vaporized fuel needs to be increased as high as possible, since the driving conditions where purging is allowed are limited as is described above, there exists a limitation on the increase in purge flow rate, and hence, it is desired to increase the purge efficiency by increasing the purge density, for example.

Figure 3:
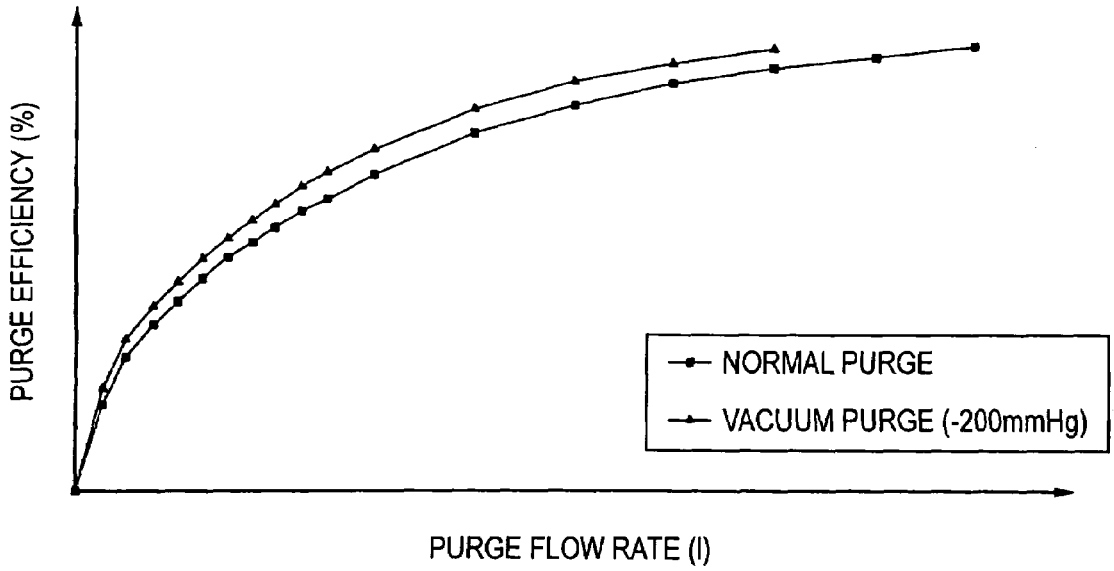
FIG. 3 is an experimental result showing the purge efficiency of butane with respect to accumulated flow rates, which explains a vacuum purge control process in the operation shown in FIG. 2.

As a result of accumulation of knowledge and judgement based thereon, the inventors eventually found that the release of butane (saturated aliphatic hydrocarbon) which is a main component of gasoline fuel from the absorbent 10*a* is promoted when the inside pressure of the canister 10 is relieved or reduced. FIG. 3 shows experimental data showing purge efficiency relative to purge flow rate, and as is seen from the data, the purge flow rate could be reduced by 20% to obtain the same purge efficiency by reducing the canister inside pressure to −200 mm Hg when the atmospheric temperature is 45° C., and the purge density could be increased to such an extent equal to the reduction.

Figure 4:
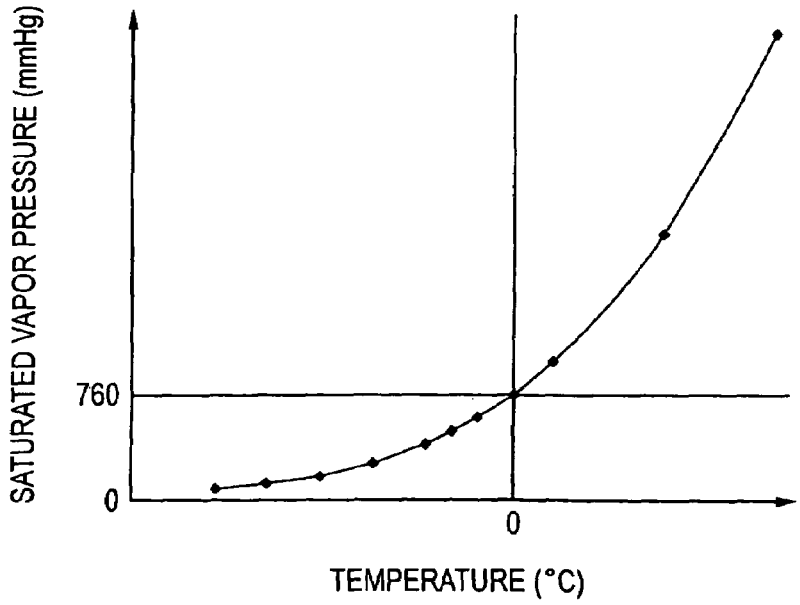
FIG. 4 is a similar graph to one shown in FIG. 3 showing the characteristics of saturated vapor pressure of butane with respect to temperatures, which explains a vacuum purge control process in the operation shown in FIG. 2.

The reason for an increase in purge efficiency by reference to FIG. 4, which is a graph showing the characteristics of saturated vapor pressure relative to the temperature of normal butane. As shown in the graph, the saturated vapor pressure of normal butane at 0° C. is substantially equal to the atmospheric pressure. There may occur a case where the temperature of the absorbent 10*a* in the canister goes down to or below the ice point, and in such a condition, the saturated vapor temperature is on a negative pressure side, where by butane is difficult to be vaporized (released). Consequently, as in the case with vacuum distillation, there is generated an environment easing the release of butane by reducing the canister inside pressure, and hence it is considered that the release of butane is promoted.

To return to the description of the flowchart in FIG. 2, if negative in S10 or S12, proceed to S20, where the atmosphere-vented valve 52*a* is opened fully (driven to the fully opened position) (namely, the operation of the pressure relief section is stopped). Next, proceed to S22 to execute a normal purge control in which the canister inside pressure is not reduced, and proceed to S24 to judge whether or not the canister inside pressure is equal to or higher than a second predetermined negative pressure C. If negative, proceed to S18, whereas if positive, proceed to S26 to fully open the charge passageway opening and closing valve 16*a* (or to drive the valve to the fully opened position).

To describe the above process, when the tank inside pressure is equal to or lower than the predetermined pressure A (for example, +50 mm Hg) and the canister inside pressure is the predetermined negative pressure B (for example,−300 mm Hg), the canister inside pressure is reduced to −200 mm Hg (S14), and a vacuum purge control is executed (S18), whereby the purge efficiency can be increased from the aforementioned reason. In addition, when the inside pressure in the canister 10*a* is negative, in case the charge passageway 16 is opened, since the negative pressure is introduced into the fuel tank 12 to give an unnecessary stress to the tank 12, the charge passageway opening and closing valve 16*a* is closed (S18) so as to prevent the application of the negative pressure to the fuel tank 12.

On the other hand, when the tank inside pressure is determined not to be equal to or lower than the predetermined pressure A, it is anticipated that there is occurring a situation where the vaporization of gasoline fuel is enhanced drastically, and this situation also gives an unnecessary stress to the fuel tank 12. In addition, when the canister inside pressure is determined not to be equal to or higher than the predetermined negative pressure B, the canister inside pressure is at, for example,−400 mm Hg, and this situation also gives an unnecessary stress to the canister 10. Consequently, in these cases, the atmosphere-vented valve 52*a* is fully opened (S20), or the charge passageway opening and closing valve 16*a* is fully opened (S26), so that the application of an unnecessary stress to the fuel tank 12 or the canister 10 is prevented. In addition, the purge control utilized is the normal purge control in which the canister inside pressure is not relieved.

Note that, as this occurs, whether or not the canister inside pressure is equal to or higher than the second predetermined negative pressure C (for example,−50 mm Hg) is determined, and if positive, the charge passageway opening and closing valve 16*a* is fully opened (S26). This step is also taken to prevent an unnecessary application of the negative pressure inside the canister to the fuel tank 12.

As is described heretofore, according to the embodiment, since the atmosphere-vented valve 52*a* is opened in the predetermined amount so as to reduce the inside pressure in the canister 10 to the first predetermined negative pressure and purging is controlled in that condition, the release of vaporized fuel from the absorbent 10*a* is promoted so as to increase the purge density, thereby making it possible to increase the purge efficiency. In other words, an equal amount of vaporized fuel can be purged into the induction system of the engine 20 at a smaller flow rate.

In addition, since the aforesaid vacuum purge control is implemented while preventing the inside pressure in the fuel tank 12 from becoming an excessively negative pressure by closing the charge passageway opening and closing valve 16*a*, there is no risk of imparting an unnecessary stress to the fuel tank 12. Consequently, the necessity is obviated of reinforcing the fuel tank 12. Furthermore, since the atmosphere-vented valve 52*a* and the charge passageway opening and closing valve 16*a* are opened when the detected inside pressure in the fuel tank 12 is higher than the predetermined pressure, even in case the inside pressure in the fuel tank 12 is increased to a positive pressure side due to a drastic increase in the amount of vaporized fuel when the vacuum purge control is being implemented, the pressure so increased can be relieved to the canister side by opening the charge passageway opening and closing valve, whereby there is no risk that an unnecessary stress is given to the fuel tank 12.

Furthermore, since, when the detected inside pressure in the canister 10 is lower than the predetermined negative pressure, the atmosphere-vented valve 52*a* is opened and the charge passageway opening and closing vale 16*a* is opened as well, the inside pressure in the canister 10 becomes an excessively negative pressure, and thus, since no unnecessary stress is applied to the canister 10, no reinforcement is required therefor. In addition, since, when the purge control is shifted from the vacuum purge control to the normal purge control, the charge passageway opening and closing valve 16*a* is opened after the canister inside pressure has increased to the second predetermined negative pressure, there is caused no risk that the canister negative pressure generated by the vacuum purge control is applied to the fuel tank 12 to make the inside pressure in the fuel tank 12 become an excessively negative pressure, whereby there is caused no risk that an unnecessary stress is imparted to the fuel tank 12.

[Second Embodiment]

Figure 5:
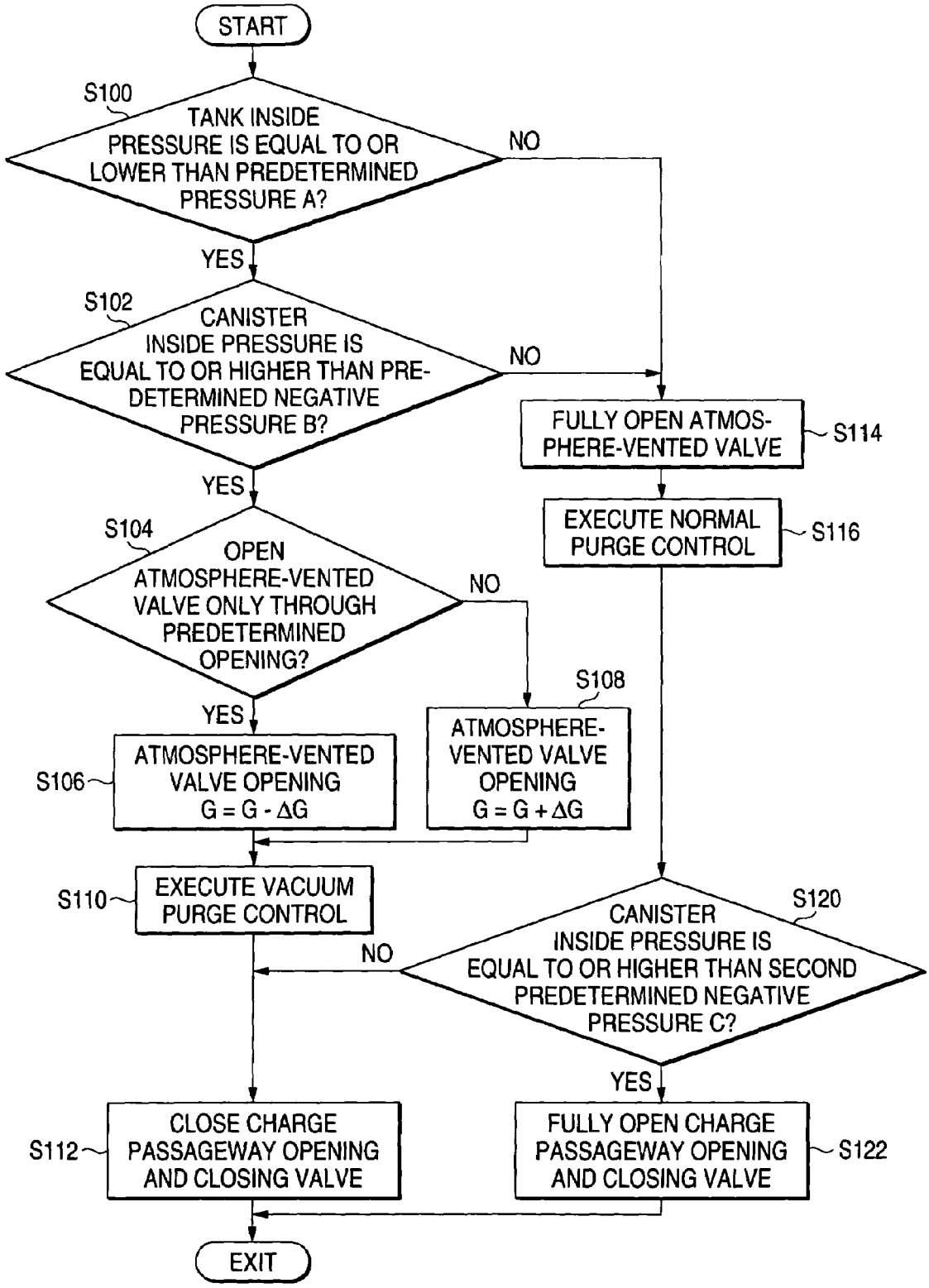
FIG. 5 is a flowchart similar to one shown in FIG. 2 which illustrates the operation of a vaporized fuel processing system according to a second embodiment of the invention.

FIG. 5 is a flowchart, identical to the flowchart shown in FIG. 2, which illustrates the operation of a vaporized fuel processing system according to a second embodiment of the invention.

To describe the operation while focusing on a difference from the first embodiment, after executing similar processes to those in the first embodiment from S100 to S102, proceed to S104, where whether or not the canister inside pressure exceeds a target value (for example,−200 mm Hg). Then, if positive, since this means that vacuum is insufficient, proceed to S106 to reduce the opening of the atmosphere-vented valve 52*a* by ΔG, in other words, the valve is driven in a valve closing direction to such an extent that the valve opening is reduced by ΔG. On the other hand, if negative in S104, proceed to S108 to drive the atmosphere-vented valve 52*a* in a valve opening direction to such an extent that the valve opening G is increased by ΔG. Note that processes from S110 to S122 are similar to those in the first embodiment.

Since the second embodiment is constructed as is described above, similar advantages to those described in the first embodiment are provided except that the canister inside pressure is feedback controlled to the target value (target negative pressure).

[Third Embodiment]

Next, a vaporized fuel processing system according to a third embodiment of the invention will be described.

To describe the system while focusing on a difference from the previous embodiments, in a third embodiment, as shown by phantom lines in FIG. 1, a pressure relief pump 70 as a pressure relief section is connected to the atmospheric passageway 52 at a position upstream of the atmosphere-vented valve 52*a* (closer to the canister 10).

In the operation of the system according to the third embodiment, in a process in S14 or S104, with the atmosphere-vented valve 52*a* being held at the fully closed position, the pressure relief pump 70 is activated so that the inside pressure in the canister 10 becomes a negative pressure in the order of −200 mm Hg.

With the system according to the third embodiment, by the addition of the pressure relief pump 70, while the configuration is made slightly complicated, a desired vacuum condition can be produced even when the induction negative pressure of the engine 20 is weak. Note that the atmosphere-vented valve 52*a* may be removed so that only the pressure relief pump 70 is left for use. The remaining construction and advantages remain the same as those described in the previous embodiments.

Thus, as is described heretofore, according to the first to third embodiments of the invention, there is provided the vaporized fuel processing system including the canister 10 for storing the adsorbent 10*a*, the charge passageway 16 which establishes a communication between the fuel tank 12 and the canister 10 so as to charge vaporized fuel (gasoline fuel 14) from the fuel tank into the canister 10 so that the vaporized fuel so charged is adsorbed onto the adsorbent in the canister, the purge passageway 50 which establishes a communication between the canister and an induction system (the induction pipe 22) of the internal combustion engine (the engine) 20 so that the vaporized fuel released from the adsorbent is purged into the induction system, the atmospheric passageway 52 which establishes a communication between the canister and the atmosphere, the purge control valve 50*a* interposed along the length of the purge passageway for opening and closing the purge passageway, the charge passageway opening and closing valve 16*a* interposed along the length of the charge passageway for opening and closing the charge passageway, the pressure relief section (the atmosphere-vented valve 52*a*, the pressure relief pump 70) interposed along the length of the atmospheric passageway, and the purge control section for controlling the opening of the purge control valve so as to control the purging, wherein the purge control section (the ECU 64, S10 to S26, S100 to S122) activates the pressure relief section so as to reduce the inside pressure of the canister to the first predetermined negative pressure (S14, S104 to S108) while preventing the inside pressure of the fuel tank from becoming an excessively negative pressure by closing the charge passageway opening and closing valve (S18, S112), whereby the purging is controlled (S16, S110) while the inside pressure of the canister is being relieved.

In addition, there is provided the vaporized fuel processing system which further includes the tank inside pressure detecting section (the pressure sensor 54) for detecting the inside pressure of the fuel tank, wherein when the inside pressure of the fuel tank so detected is higher than the predetermined pressure (S10, S100), the purge control section stops the operation of the pressure relief section (S20, S114) and opens the charge passageway opening and closing valve (S26, S122).

Furthermore, there is provided the vaporized fuel processing system which further includes the canister inside pressure detecting section (the pressure sensor 56) for detecting the inside pressure of the canister, wherein when the inside pressure of the canister so detected is lower than the predetermined negative pressure (S22, S116), the purge control section stops the operation of the pressure relief section and opens the charge passageway opening and closing valve (S26, S122).

Moreover, there is provided the vaporized fuel processing system which further includes the canister inside pressure detecting section (the pressure sensor 56) for detecting the inside pressure of the canister, wherein the purge control section opens the charge passageway opening and closing valve (S26, S122) after the inside pressure of the canister has increased to the second predetermined negative pressure (S24, S120) when purge control is shifted from the purge control that is implemented by relieving the inside pressure of the canister to the normal purge control that is implemented by stopping the operation of the pressure relief section (S22, S116).

Note that, in the respective embodiments that are described heretofore, while the charge passageway opening and closing valve is described as operating only between the fully closed position and the fully opened position, it may be made to be a valve which can be set at any opening therebetween.

What is claimed is:

1. A vaporized fuel processing system comprising:

a canister for storing an adsorbent;

a charge passageway which establishes a communication between a fuel tank and the canister so as to charge vaporized fuel from the fuel tank into the canister so that the vaporized fuel so charged is adsorbed onto the adsorbent in the canister;

a purge passageway which establishes a communication between the canister and an induction system of an internal combustion engine so that the vaporized fuel released from the adsorbent is purged into the induction system;

an atmospheric passageway which establishes a communication between the canister and the atmosphere;

a purge control valve interposed along the length of the purge passageway for opening and closing the purge passageway;

a charge passageway opening and closing valve interposed along the length of the charge passageway for opening and closing the charge passageway;

a pressure relief section interposed along the length of the atmospheric passageway; and a purge control section for controlling the opening of the purge control valve so as to control the purging, wherein the purge control section activates the pressure relief section so as to reduce an inside pressure of the canister to a first predetermined negative pressure while preventing an inside pressure of the fuel tank from becoming an excessively negative pressure by closing the charge passageway opening and closing valve, whereby the purging is controlled while the inside pressure of the canister is being relieved.

2. The vaporized fuel processing system as set forth in claim 1, further comprising:

a tank inside pressure detecting section for detecting the inside pressure of the fuel tank, wherein when the inside pressure of the fuel tank so detected is higher than a predetermined pressure, the purge control section stops the operation of the pressure relief section and opens the charge passageway opening and closing valve.

3. The vaporized fuel processing system as set forth in claim 1, further comprising:

a canister inside pressure detecting section for detecting the inside pressure of the canister, wherein when the inside pressure of the canister so detected is lower than the predetermined negative pressure, the purge control section stops the operation of the pressure relief section and opens the charge passageway opening and closing valve.

4. The vaporized fuel processing system as set forth in claim 1, further comprising:

a canister inside pressure detecting section for detecting the inside pressure of the canister, wherein the purge control section opens the charge passageway opening and closing valve after the inside pressure of the canister has increased to a second predetermined negative pressure when purge control is shifted from the purge control that is implemented by relieving the inside pressure of the canister to a normal purge control that is implemented by stopping the operation of the pressure relief section.

5. The vaporized fuel processing system as set forth in claim 1, wherein the charge passageway opening and closing valve operates only between the fully closed position and the fully opened position.

6. The vaporized fuel processing system as set forth in claim 1, wherein the charge passageway opening and closing valve is capable to be set at any opening between the fully closed position and the fully opened position.

7. A vaporized fuel processing method comprising the steps of:

storing an adsorbent in a canister;

communicating between a fuel tank and the canister by a charge passageway;

charging vaporized fuel from the fuel tank into the canister;

adsorbing the vaporized fuel so charged onto the adsorbent in the canister;

communicating between the canister and an induction system of an internal combustion engine by a purge passageway;

purging the vaporized fuel released from the adsorbent into the induction system;

communicating between the canister and the atmosphere by an atmospheric passageway;

opening and closing the purge passageway by a purge control valve interposed along the length of the purge passageway;

opening and closing the charge passageway by a charge passageway opening and closing valve interposed along the length of the charge passageway;

interposing a pressure relief section along the length of the atmospheric passageway;

controlling the opening of the purge control valve so as to control the purging by a purge control section;

activating the pressure relief section by the purge control section; and reducing an inside pressure of the canister to a first predetermined negative pressure while preventing an inside pressure of the fuel tank from becoming an excessively negative pressure by closing the charge passageway opening and closing valve, whereby the purging is controlled while the inside pressure of the canister is being relieved.

8. The vaporized fuel processing method as set forth in claim 7, further comprising the steps of:

detecting the inside pressure of the fuel tank by a tank inside pressure detecting section, and when the inside pressure of the fuel tank so detected is higher than a predetermined pressure, stopping the operation of the pressure relief section and opening the charge passageway opening and closing valve by the purge control section.

9. The vaporized fuel processing method as set forth in claim 7, further comprising the steps of:

detecting the inside pressure of the canister by a canister inside pressure detecting section, and when the inside pressure of the canister so detected is lower than the predetermined negative pressure, stopping the operation of the pressure relief section and opening the charge passageway opening and closing valve by the purge control section.

10. The vaporized fuel processing method as set forth in claim 7, further comprising the steps of:

detecting the inside pressure of the canister by a canister inside pressure detecting section, and opening the charge passageway opening and closing valve by the purge control section after the inside pressure of the canister has increased to a second predetermined negative pressure, when purge control is shifted from the purge control that is implemented by relieving the inside pressure of the canister to a normal purge control that is implemented by stopping the operation of the pressure relief section.

11. The vaporized fuel processing method as set forth in claim 7, further comprising a step of:

operating only between the fully closed position and the fully opened position by the charge passageway opening and closing valve.

12. The vaporized fuel processing method as set forth in claim 7, further comprising a step of:

setting at any opening between the fully closed position and the fully opened position by the charge passageway opening and closing valve.

13. A medium for recording a program for performing a vaporized fuel processing comprising the steps of:

storing an adsorbent in a canister;

communicating between a fuel tank and the canister by a charge passageway;

charging vaporized fuel from the fuel tank into the canister;

adsorbing the vaporized fuel so charged onto the adsorbent in the canister;

communicating between the canister and an induction system of an internal combustion engine by a purge passageway;

purging the vaporized fuel released from the adsorbent into the induction system;

communicating between the canister and the atmosphere by an atmospheric passageway;

opening and closing the purge passageway by a purge control valve interposed along the length of the purge passageway;

opening and closing the charge passageway by a charge passageway opening and closing valve interposed along the length of the charge passageway;

interposing a pressure relief section along the length of the atmospheric passageway;

controlling the opening of the purge control valve so as to control the purging by a purge control section;

activating the pressure relief section by the purge control section; and reducing an inside pressure of the canister to a first predetermined negative pressure while preventing an inside pressure of the fuel tank from becoming an excessively negative pressure by closing the charge passageway opening and closing valve, whereby the purging is controlled while the inside pressure of the canister is being relieved.

14. The medium for recording a program for performing the vaporized fuel processing as set forth in claim 13, further comprising the steps of:

detecting the inside pressure of the fuel tank by a tank inside pressure detecting section, and when the inside pressure of the fuel tank so detected is higher than a predetermined pressure, stopping the operation of the pressure relief section and opening the charge passageway opening and closing valve by the purge control section.

15. The medium for recording a program for performing the vaporized fuel processing as set forth in claim 13, further comprising the steps of:

detecting the inside pressure of the canister by a canister inside pressure detecting section, and when the inside pressure of the canister so detected is lower than the predetermined negative pressure, stopping the operation of the pressure relief section and opening the charge passageway opening and closing valve by the purge control section.

16. The medium for recording a program for performing the vaporized fuel processing as set forth in claim 13, further comprising the steps of:

detecting the inside pressure of the canister by a canister inside pressure detecting section, and opening the charge passageway opening and closing valve by the purge control section after the inside pressure of the canister has increased to a second predetermined negative pressure, when purge control is shifted from the purge control that is implemented by relieving the inside pressure of the canister to a normal purge control that is implemented by stopping the operation of the pressure relief section.

17. The medium for recording a program as set forth in claim 13, further comprising a step of:

operating only between the fully closed position and the fully opened position by the charge passageway opening and closing valve.

18. The medium for recording a program as set forth in claim 13, further comprising a step of:

setting at any opening between the fully closed position and the fully opened position by the charge passageway opening and closing valve.

* * * * *